US006098534A

United States Patent [19]

Shanahan et al.

[11] Patent Number: 6,098,534

[45] Date of Patent: Aug. 8, 2000

[54] EMBOSSER HAVING LIMITED CANT HAMMER AND METHOD OF MANUFACTURE THEREOF

[75] Inventors: James William Shanahan; Lawrence John Hannan, both of Mount Pleasant, Tex.

[73] Assignee: Mastercraft Industries, L.P., Mount Pleasant, Tex.

[21] Appl. No.: 09/347,350

[22] Filed: Jul. 2, 1999

[51] Int. Cl.[7] ..... B41F 17/24; B44B 5/00

[52] U.S. Cl. ..... 101/4; 101/9; 101/27; 101/32

[58] Field of Search ..... 101/4, 9, 11, 27, 101/28, 31, 32, 487

[56] References Cited

U.S. PATENT DOCUMENTS

| | | | |
|---|---|---|---|
| 1,144,340 | 6/1915 | Campbell | 101/4 |
| 3,157,114 | 11/1964 | Halverson | 101/4 |
| 3,731,619 | 5/1973 | Petrikovsky | 101/4 |
| 4,182,239 | 1/1980 | Timmins et al. | 101/11 |
| 4,373,436 | 2/1983 | Shenoha | 101/27 |
| 4,542,690 | 9/1985 | Kikuchi | 101/27 |

FOREIGN PATENT DOCUMENTS

| | | | |
|---|---|---|---|
| 538759 | 12/1976 | U.S.S.R. | 101/4 |

*Primary Examiner*—John S. Hilten
*Assistant Examiner*—Leslie J. Grohusky

[57] ABSTRACT

An embosser and a method of manufacturing the same. In one embodiment, the embosser has a frame, a hammer and an anvil and includes: (1) a ram coupled to the frame and oriented to apply a force in a given direction and (2) force translators, coupled to the ram and the hammer, that reorient the force in a direction substantially normal to a plane of a face of the hammer and limit a cant of the hammer with respect to the anvil.

21 Claims, 5 Drawing Sheets

EMBOSSER HAVING LIMITED CANT HAMMER AND METHOD OF MANUFACTURE THEREOF

TECHNICAL FIELD OF THE INVENTION

The present invention is directed, in general, to an embosser and, more specifically, to an embosser having a limited cant hammer that renders it capable of embossing relatively large workpieces of varying hardness.

BACKGROUND OF THE INVENTION

Historically, embossers have been successfully used to imprint a pattern into a material by applying a force, by means of a press or hammer, to a die held against the material, with the material resting on an anvil. However, embossers have been primarily limited to using homogeneous materials, such as metal, because these materials respond almost uniformly through the thickness and across the span of the material. A relatively inexpensive material that has not found much application with embossers is wood. Because wood forms under widely varying climatic conditions, wood is a non-uniform, almost heterogeneous, material. That is, wood, even within a single piece, is not uniform in density. It is this very non-uniformity that gives many woods a beauty that is highly prized. Therefore, one part of a wood workpiece may be considerably more dense than another part. Thus, classic wood forming techniques include cutting, planing, drilling, burning, and routing. Each of these methods achieves the desired effect by removing some portion of the wood. In embossing, however, no material is removed; rather it is reshaped using pressure (force) and, in some instances, heat.

For many commercial products, it would be highly desirable to combine the cost, availability, and beauty of wood with the ease of applying a design by embossing. However, because of the non-uniform density problem, attempting to emboss wood often causes the embossing die to cant with respect to a normal to the face of the work piece when the die encounters a very dense portion of wood. The result is a distorted product. In general, the problem is greater as the area of the workpiece increases. Additionally, the presses capable of performing embossing of this nature are quite large and may weigh up to 10 tons. To be economically productive these machines require multiple dies to form multiple pieces in a single pressing, because the function rate for the presses is quite slow. Therefore, tooling costs are significantly increased.

Accordingly, what is needed in the art is a single die, wood embosser of a reasonable size that significantly limits the amount of cant that is allowed of the hammer and the die as force is transmitted to the wood. The embosser should also permit rapid processing of one workpiece at a time.

BRIEF SUMMARY OF THE INVENTION

To address the above-discussed deficiencies of the prior art, the present invention provides an embosser and a method of manufacturing the same. In one embodiment, the embosser has a frame, a hammer and an anvil and includes: (1) a ram coupled to the frame and oriented to apply a force in a given direction and (2) force translators, coupled to the ram and the hammer, that reorient the force in a direction substantially normal to a plane of a face of the hammer and limit a cant of the hammer with respect to the anvil.

The present invention therefore introduces the broad concept of evenly spreading the force of a single ram to ensure that the hammer does not cant, even when it is caused to bear against an uneven workpiece (such as wood).

In one embodiment of the present invention, the ram comprises a cylinder and a piston reciprocable therein. In a more specific embodiment, the embosser further includes a pneumatic source coupled to the ram. The ram may therefore be pneumatic. Alternatively, the ram may be hydraulic, electrical or mechanically actuated. Those skilled in the pertinent art will understand that the present invention is not limited to a ram of any particular type.

In one embodiment of the present invention, the force translators prevent the cant. Of course, some amount of cant may be tolerated in some applications. "Cant" is broadly defined to be rotation in any direction along any axis out of the plane of the face of the hammer.

In one embodiment of the present invention, the force translators comprise cams having a plurality of hammer stroke regions. In a related embodiment, the force translators comprise a plurality of rotatable followers. In embodiments to be illustrated and described, the cams alternately take the form of simple wedged ramps and more complex, multi-step guides.

In one embodiment of the present invention, the embosser further includes a heater coupled to the hammer to allow thermal communication with a die. The heater may alternatively be coupled to the anvil. However, as those skilled in the pertinent art are aware, it is advantageous to locate the heater such that the die is heated efficiently.

The foregoing has outlined, rather broadly, preferred and alternative features of the present invention so that those skilled in the pertinent art may better understand the detailed description of the invention that follows. Additional features of the invention will be described hereinafter that form the subject of the claims of the invention. Those skilled in the pertinent art should appreciate that they can readily use the disclosed conception and one or more specific embodiments as a basis for designing or modifying other structures for carrying out the same purposes of the present invention. Those skilled in the pertinent art should also realize that such equivalent constructions do not depart from the spirit and scope of the invention in its broadest form or the claims.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
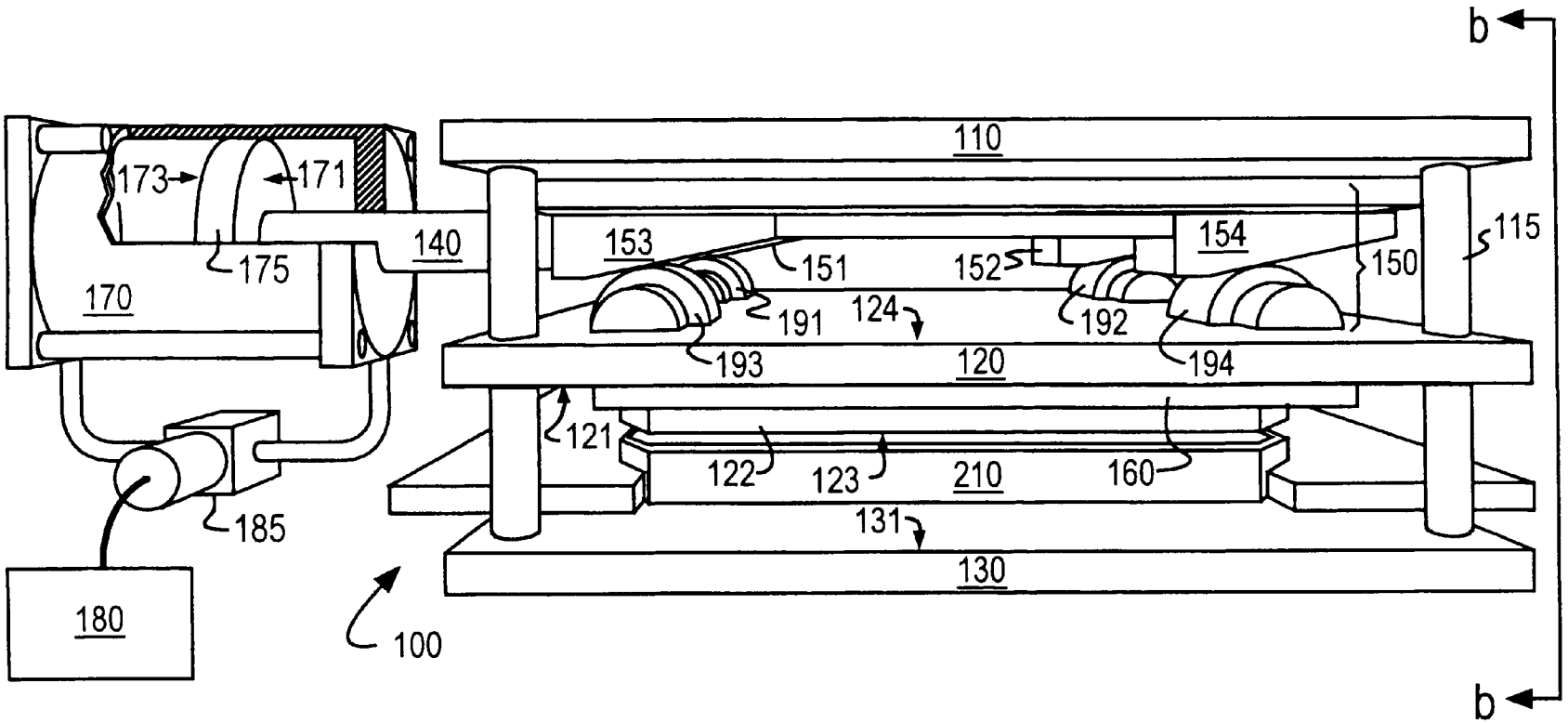
FIG. 1A illustrates a side perspective view of one embodiment of an embosser constructed according to the principles of the present invention.
Figure 1B:
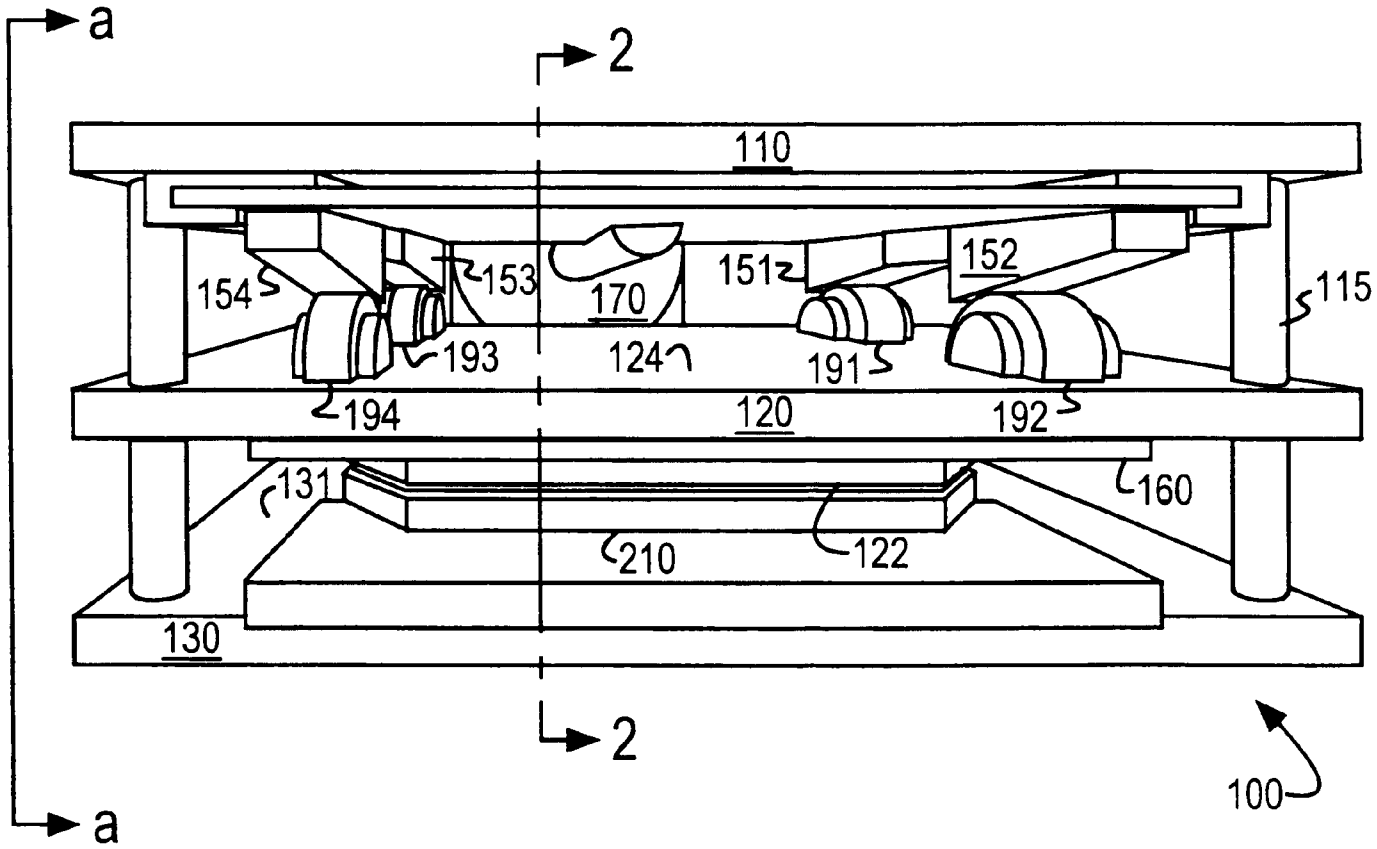
FIG. 1B illustrates an end perspective view of the embosser of FIG. 1A.

Referring initially to FIGS. 1A and 1B, illustrated are side and end perspective views, respectively, of one embodiment of an embosser constructed according to the principles of the present invention. An embosser, generally designated 100, comprises a frame 110, a hammer 120, an anvil 130, a ram 140, and a plurality of force translators 150. The anvil 130 is fixedly coupled to the frame 110, whereas the hammer 120 and ram 140 are movably coupled to the frame 110. The hammer 120 is constrained to move essentially vertically along a plurality of guide poles 115. In the illustrated embodiment, the hammer 120 is coupled to a die 122 that has a relief embossing pattern formed in a face 123 thereof. One who is skilled in the art is familiar with embossing dies. In an alternative embodiment, the die 122 may be integrally formed in a face 121 of the hammer 120. In a preferred embodiment, the hammer face 121 is substantially planar and parallel to a face 131 of the anvil 130 that is also substantially planar. In the illustrated embodiment, the die 122 is coupled to a heater 160 that elevates the temperature of the die 122 to facilitate embossing.

In one embodiment, the ram 140 further includes a piston 175 within a pneumatic cylinder 170. The piston 175 is coupled to a pneumatic source 180 through a controller 185 and is configured to give the ram 140 an essentially horizontal motion. Motion of the piston 175 is controlled by the controller 185 that meters an operating gas to a selected side 171, 173 of the piston 175. In alternative embodiments, the piston 175 may be hydraulically, electrically, or mechanically actuated. One who is skilled in the art is familiar with the operation of pneumatic, hydraulic, or mechanically actuated pistons.

In one embodiment, the force translators include a plurality of inclined planes 151, 152, 153, 154 that act as cams and are movably coupled to a plurality of rollers 191, 192, 193, 194, mounted to an upper surface 124 of the hammer 120. In the illustrated embodiment, four force translators 150 are coupled to the hammer 120. However, one who is skilled in the art will readily conceive of other numbers of force translators 150 that may be employed with suitable efficacy.

Figure 2A:
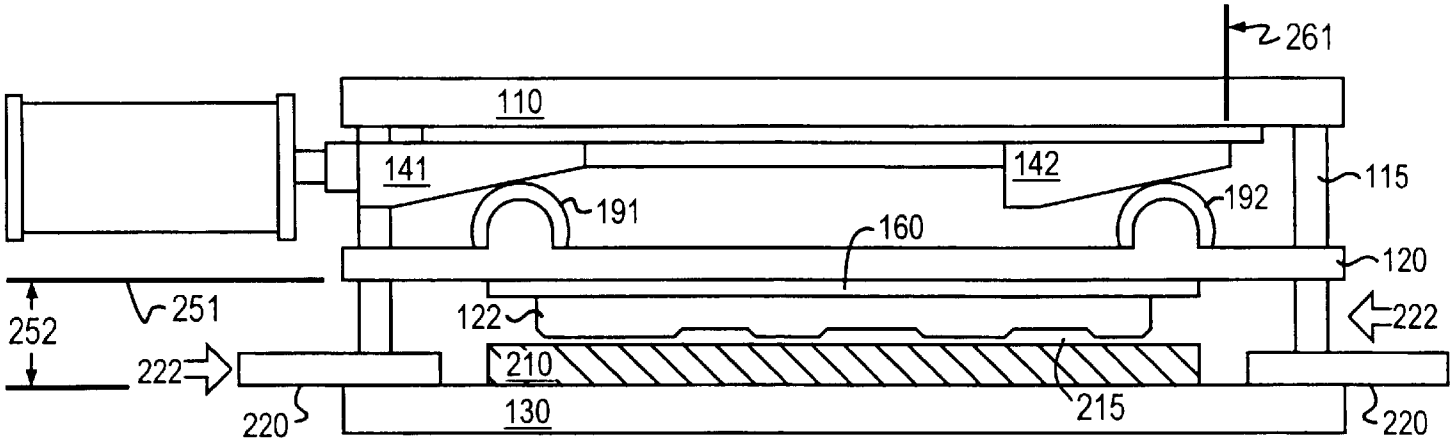
FIG. 2A illustrates the embosser of FIGS. 1A and 1B with the hammer and die retracted.
Figure 2B:
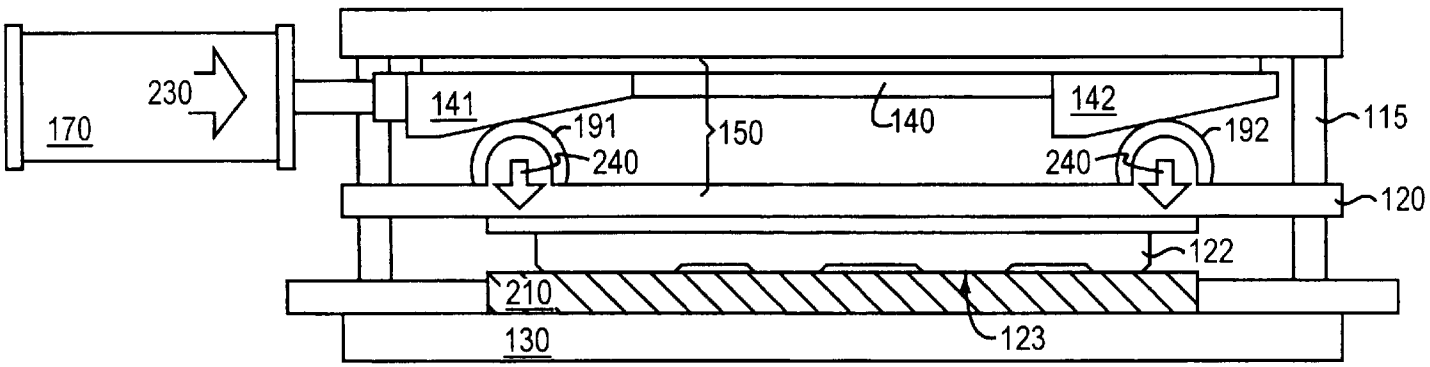
FIG. 2B illustrates the embosser of FIGS. 1A and 1B with the die in contact with the workpiece.
Figure 2C:
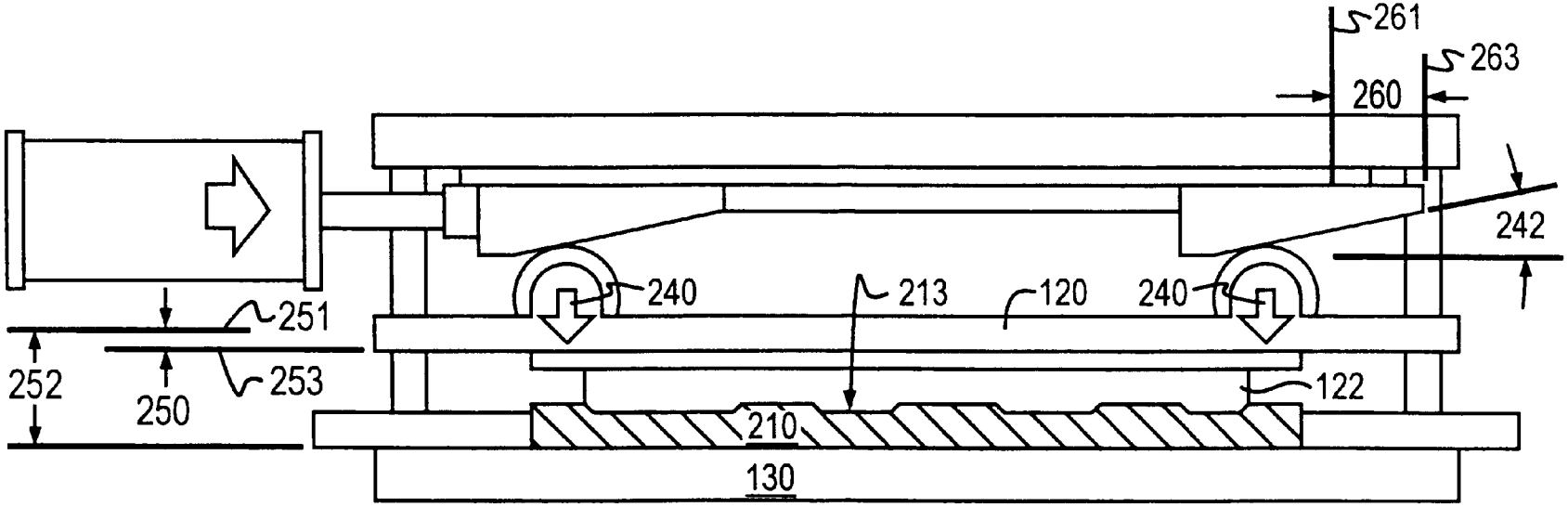
FIG. 2C illustrates the embosser of FIGS. 1A and 1B with the workpiece formed by the die.

Referring now to FIGS. 2A, 2B and 2C with continuing reference to FIGS. 1A and 1B, illustrated are progressive sectional views of the embosser of FIGS. 1A and 1B along plane 2A—2A as a workpiece is embossed. In FIG. 2A, illustrated is the embosser of FIGS. 1A and 1B with the hammer 120 and die 122 retracted. A workpiece 210 has been placed onto the anvil 130 between positioners 220. Positioners 220 are moved by forces 222 so as to align the workpiece 210 with the die 122 for embossing. In a particularly advantageous aspect of the present invention, the workpiece 210 may be wood. The hammer 120 and die 122 are retracted to a position allowing inclined planes 141, 142 to contact rollers 191, 192 respectively, while allowing clearance 215 to enable the workpiece 210 to be positioned. One who is skilled in the art will readily envision employment of tension or compression springs (not shown), or other means for retracting the hammer 120 and die 122. The retracted position of the ram 140 should be noted as indicated at 261. Similarly, the hammer 120 is raised to a position 251 at a height 252 above the anvil. In one embodiment, the die 122 may be heated by the heater 160 to a temperature sufficient to expedite embossing of the workpiece 210.

Referring now to FIG. 2B, illustrated is the embosser of FIGS. 1A and 1B with the die in contact with the workpiece. A force 230 is applied by the pneumatic cylinder 170 to the ram 140, translating the ram 140 horizontally. As the ram 140 translates horizontally, rollers 191, 192, roll upon inclined planes 141, 142 respectively. Force translators 150 effectively redirect and distribute the ram force 230 as a plurality of forces 240 that are transferred to the workpiece 210 through the hammer 120 and die 122. The plurality of forces 240 are essentially normal to the die face 123. By distributing the forces 240 and guiding the hammer 120 on the guide poles 115, the die face 123 is effectively limited in the amount of cant of the die 122 that may occur during embossing, regardless of the nature of the workpiece 210.

Referring now to FIG. 2C with continuing reference to FIG. 2A, illustrated is the embosser of FIGS. 1A and 1B with the workpiece formed by the die. Forces 240 cause the hammer 120 and die 122 to continue a downward motion guided by the guide poles 115, so that a surface 213 of the workpiece 210 is embossed with the design of the die 122. A ram stroke 260 is evidenced by the start position 261 shown in FIG. 2A and an end position 263 shown in FIG. 2C. A depth 250 to which the die 122 is extended is controlled by the ram stroke 260. The depth 250 is evidenced by a start position 251 shown in FIG. 2A and an end position 253 shown in FIG. 2C. One who is skilled in the art is familiar with the fact that the depth 250 of the die stroke is a function of an angle 242 of the inclined planes 141, 142.

Figure 3A:
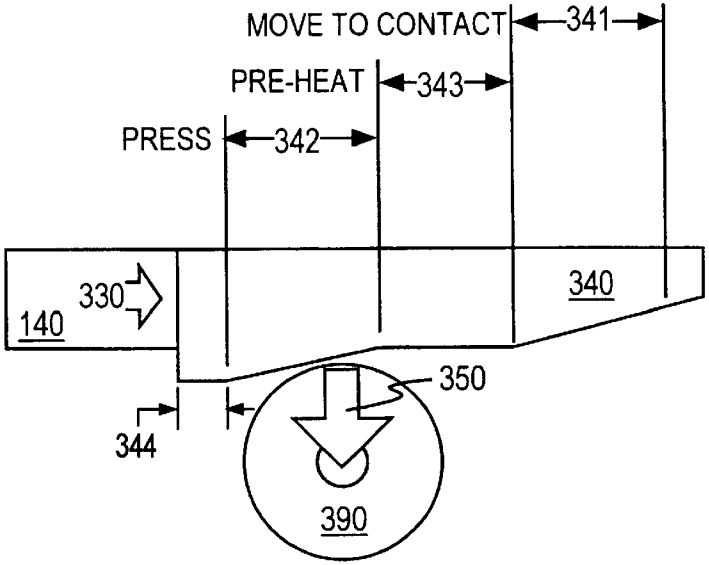
FIG. 3A illustrates an alternative embodiment of the inclined plane of FIG. 1A.

Referring now to FIG. 3A with continuing reference to FIG. 1A, illustrated is an alternative embodiment of the inclined plane of FIG. 1A. In this embodiment, an inclined plane 340 includes a plurality of progressive stroke regions 341, 342, with first and second neutral regions 343, 344 during which the hammer 120 does not move vertically. A force 330 is applied by the ram 140 translating inclined plane 340 in the direction of the force 330. As the inclined plane 340 traverses roller 390 in region 341, the hammer 120 and die 122 are moved downward to first contact the workpiece 210. This first contact may form a first impression on the resilient wood workpiece 210 in response to applied forces 350. While the inclined plane 340 traverses roller 390 in neutral region 343, the hammer 120 and die 122 do not move vertically, and the die 122 may be heated by heater 160.

Figure 3B:
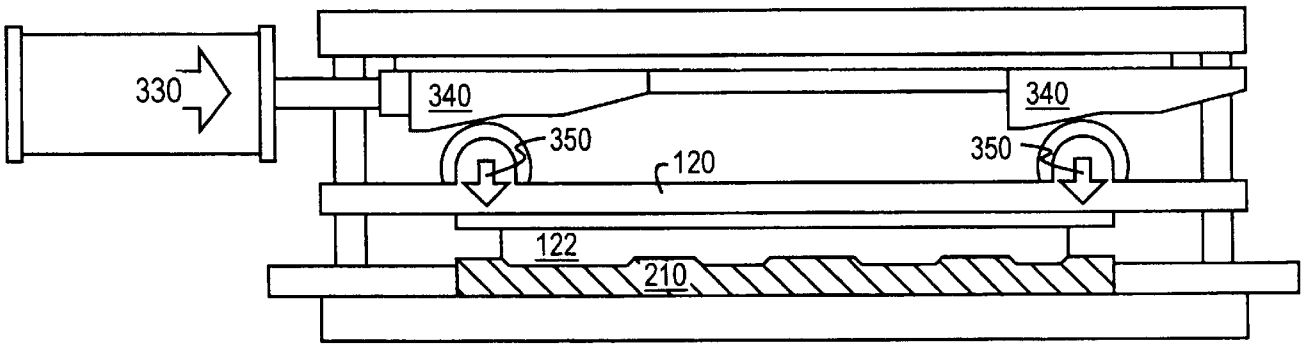
FIG. 3B illustrates a sectional view of the embosser of FIGS. 1A and 1B employing the inclined plane of FIG. 3A.

Referring now to FIG. 3B with continuing reference to FIG. 3A, illustrated is a sectional view of the embosser of FIGS. 1A and 1B employing the inclined plane 340 of FIG. 3A. When the inclined plane 340 traverses roller 390 in region 342, the hammer 120 and die 122 move vertically downward and the horizontal force 330 is redirected and distributed to an essentially downward force 350 at each of the four rollers 191, 192, 193, 194 and the hammer 120, in turn, embossing the workpiece 210. When the inclined plane 340 traverses roller 390 in neutral region 344, the hammer 120 and die 122 hold their vertical position, allowing the resilient wood workpiece 210 to accept embossing.

Thus, an embosser 100 (see FIGS. 1A and 2B) has been described that has a frame 110, a hammer 120 and an anvil 130 and includes: (1) a ram 140 coupled to the frame 110 and oriented to apply a force 230 in a given direction and (2) force translators 150, coupled to the ram 140 and the hammer 120, that reorient the force 230 in a direction substantially normal to a plane of the hammer face 121 and limit a cant of the hammer 120 with respect to the anvil 130.

Although one or more embodiments of the present invention have been described in detail, those skilled in the pertinent art should understand that they can make various changes, substitutions and alterations thereto without departing from the spirit and scope of the invention in its broadest form or the claims.

What is claimed is:

1. An embosser having a frame, a hammer and an anvil, comprising:

a ram coupled to said frame and oriented to apply a force in a given direction; and force translators coupled to said ram and said hammer, said force translators configured to reorient said force in a direction substantially normal to a plane of a face of said hammer and further configured to limit canting of said hammer with respect to said anvil, said force translators formed as multi-step guides and having a plurality of hammer stroke regions.

2. The embosser as recited in claim 1 wherein said ram comprises a cylinder and a piston reciprocable therein.

3. The embosser as recited in claim 1 further comprising a pneumatic source coupled to said ram.

4. The embosser as recited in claim 1 wherein said force translators are configured to prevent canting of said hammer.

5. The embosser as recited in claim 1 wherein said plurality of hammer stroke regions further comprise a plurality of inclined planes.

6. The embosser as recited in claim 1 wherein said force translators further comprise a plurality of rotatable followers.

7. The embosser as recited in claim 1 further comprising a heater coupled to said hammer to allow thermal communication with a die.

8. A method of manufacturing an embosser, comprising:

coupling a hammer and an anvil to a frame;

coupling a ram to said frame, said ram oriented to apply a force in a given direction; and coupling force translators to said ram and said hammer, said force translators configured to reorient said force in a direction substantially normal to a plane of a face of said hammer and further configured to limit canting of said hammer with respect to said anvil, said force translators formed as multi-step guides and having a plurality of hammer stroke regions.

9. The method as recited in claim 8 wherein said coupling said ram comprises coupling a cylinder and a piston reciprocable therein to said frame.

10. The method as recited in claim 8 further comprising coupling a pneumatic source to said ram.

11. The method as recited in claim 8 wherein said force translators are configured to prevent canting of said hammer.

12. The method as recited in claim 8 wherein coupling force translators comprises providing a plurality of hammer stroke regions having a plurality of inclined planes.

13. The method as recited in claim 8 wherein said coupling said force translators further comprises providing a plurality of rotatable followers.

14. The method as recited in claim 8 further comprising coupling a heater to said hammer to allow thermal communication with a die.

15. An embosser, comprising:

a frame;

a substantially planar hammer;

a substantially planar anvil substantially parallel to said hammer;

a ram coupled to said frame and oriented to apply a force in a given direction abnormal to a plane of said hammer; and force translators coupled to said ram and said hammer, said force translators configured to reorient said force in a direction substantially normal to said plane and further configured to limit canting of said hammer with respect to said anvil, said force translators formed as multi-step guides and having a plurality of hammer stroke regions.

16. The embosser as recited in claim 15 wherein said ram comprises a cylinder and a piston reciprocable therein.

17. The embosser as recited in claim 15 further comprising a pneumatic source coupled to said ram.

18. The embosser as recited in claim 15 wherein said force translators are configured to prevent canting of said hammer.

19. The embosser as recited in claim 15 wherein said force translators comprise a plurality of inclined planes.

20. The embosser as recited in claim 15 wherein said force translators further comprise a plurality of rotatable followers.

21. The embosser as recited in claim 15 further comprising a heater coupled to said hammer to allow thermal communication with a die.

* * * * *